United States Patent [19]

Tarkinson

[11] 4,279,796

[45] Jul. 21, 1981

[54] CARPET CLEANING/COATING MIXTURE AND METHOD

[75] Inventor: Kevork W. Tarkinson, Boynton Beach, Fla.

[73] Assignee: Ann Ward Tarkinson, Boynton Beach, Fla.

[21] Appl. No.: 132,393

[22] Filed: Mar. 20, 1980

[51] Int. Cl.[3] ..... B08B 3/08

[52] U.S. Cl. ..... 260/29.6 R; 8/137

[58] Field of Search ..... 260/29.6 R; 8/137

[56] References Cited

U.S. PATENT DOCUMENTS

| | | | |
|---|---|---|---|
| 3,104,152 | 9/1963 | McMackin | 8/137 |
| 3,923,715 | 12/1975 | Dettre | 260/29.6 R |
| 3,982,891 | 9/1976 | Murray | 8/137 |
| 4,080,351 | 3/1978 | Zalzal | 260/29.6 SQ |
| 4,219,333 | 8/1980 | Harris | 8/137 |

*Primary Examiner*—Paul R. Michl

*Attorney, Agent, or Firm*—Oltman and Flynn

[57] ABSTRACT

An aqueous dispersion of carpet protector is provided with an additional ingredient which converts it to a carpet cleaner. The aqueous dispersion preferably contains a nonfluorinated vinyl polymer and a perfluoroalkyl ester of carboxylic acid. The additional ingredient is hydrogen peroxide or carbonated water. The mixture is applied to carpet and buffed to cause foaming and loosen soil. A pad in the buffer removes soil. After drying, a soil repellent coating remains on the fibers.

2 Claims, No Drawings

CARPET CLEANING/COATING MIXTURE AND METHOD

SUMMARY OF THE INVENTION

The present invention relates to an aqueous dispersion which can be applied to carpet to clean it and leave a coating which enhances the carpet's resistance, and to a method of treating carpet by applying such an aqueous dispersion.

E. I. duPont de Nemours & Co. of Wilmington, Delaware, produces and sells a product named "TEFLON® MF CARPET PROTECTOR", which is an aqueous organic mixture with a pH in the range of 3 to 4 for application to synthetic and natural textile fiber carpeting to enhance the carpet's resistance to soiling. According to the best information available to applicant, the above-identified duPont product is formulated in accordance with U.S. Pat. No. 3,923,715 to which reference may be had for a detailed explanation of its chemical composition and various methods of preparing it.

The present invention resides in the discovery that the practical utility of the foregoing product is greatly enhanced by the addition of hydrogen peroxide in a concentration effective to cause the mixture to remove existing soil from the carpet without, however, substantially reducing its soil repelling properties after drying on the carpet. Thus, onestep treatment of the carpet to both remove existing soil and coat the carpet fibers for soil resistance in the future is made possible by the present invention.

DETAILED DESCRIPTION

The starting ingredient from which the present invention proceeds preferably is the above-identified duPont product sold under the name "TEFLON® MF CARPET PROTECTOR", which is understood to be an aqueous dispersion containing a nonfluorinated vinyl polymer and at least 5 weight percent of a perfluoroalkyl ester to a carboxylic acid of from 3 to 30 carbon atoms, as disclosed more fully in the aforementioned U.S. Pat. No. 3,923,715. The concentrations of the vinyl polymer and the perfluoroalkyl ester in this aqueous dispersion are selected so that after the aqueous dispersion is coated on the carpet, the carpet fibers have substantially better soil resistance than they would have in the absence of such coating.

In accordance with the present invention, an additional ingredient is added to the foregoing starting ingredient. This additional ingredient is hydrogen peroxide, which may be used by professional carpet cleaners. While I am not certain of the chemical reaction, if any, between this additional ingredient and the starting ingredient, the observable effect is that with the additional ingredient present the mixture very effectively cleans existing soil from the carpet to which it is applied. Also, after the mixture dries it leaves a coating on the carpet fibers which acts as a soil repellent with substantially the same effectiveness as the starting solution alone.

In the following example, the present cleaning/coating mixture is applied after the carpet has been vacuum cleaned. Following this, the present cleaning/coating mixture is sprayed evenly onto the carpet at a rate of about 1 gallon per 400 square feet and then the carpet is buffed by a motor-driven, soft, resilient, absorbent pad covered by a nylon screen. It is observable that the cleaning/coating mixture wets the carpet fibers after being sprayed on. The mechanical agitation from buffing causes an effervescing or foaming action of the cleaning/coating mixture which enhances its penetration into the carpet to remove existing soil and to leave a soil repellent coating on the carpet fibers. During buffing, much of the wet mixture and dirt it has removed from the carpet is absorbed by the pad in the buffing machine. After buffing, the carpet is allowed to dry, which normally takes 2 to 4 hours, and then preferably is vacuum cleaned again. In the case of shag carpet, it should be raked or otherwise groomed shortly after buffing.

CLEANING/COATING SOLUTION—EXAMPLE

4–7 weight percent of duPont "TEFLON® MF CARPET PROTECTOR" was mixed with 96–93 percent of an aqueous solution of hydrogen peroxide, containing 7 weight percent hydrogen peroxide and the balance water. This mixture was then applied to carpet in the manner already described. It appeared that dry electrolysis occurred 24–36 hours after the carpet was buffed.

The use of the present cleaning/coating mixture is advantageous in that no objectionable residue is left in the carpet, whereas other cleaning methods may leave surfactants,detergents or soaps as residues in the carpet. The only residue is the soil-repellent coating provided by the duPont "TEFLON® CARPET PROTECTOR" after it dries.

Another advantage of the present cleaning/coating mixture is that it very effectively removes surfactant, detergent or soap residues left in the carpet by previous cleanings which used other known carpet cleaning techniques.

Also, the present cleaning/coating mixture is less damaging to the carpet material than such previously used carpet cleaning techniques as hot water ("steam") cleaning and shampooing, and it has no deleterious effect on the carpet padding, whether felt or foam rubber.

From the practical standpoint, the present cleaning-/coating mixture is especially advantageous in that cleaning the carpet to remove existing soil and coating it to repel future soiling are accomplished in the same buffing step, and a subsequent refinishing step is not required.

I claim:

1. In an aqueous dispersion containing a nonfluorinated vinyl polymer and at least 5 weight percent of a perfluoroalkyl ester of a carboxylic acid of from 3 to 30 carbon atoms in amounts effective to provide substantial dry soil resistance in carpet to which said aqueous dispersion is applied, the improvement which comprises:

an additional ingredient in said aqueous dispersion consisting of hydrogen peroxide in an amount effective to remove soil from carpet to which said aqueous dispersion is applied followed by buffing the carpet to promote foaming of the aqueous dispersion.

2. A method of cleaning existing soil from carpet and enhancing its resistance to future soiling which comprises the steps of (1) applying to the carpet an aqueous dispersion containing:

in concentration effective to provide substantial dry soil resistance in the carpet, a nonfluorinated vinyl polymer and a perfluoroalkyl ester of a carboxylic acid of from 3 to 30 carbon atoms;

and, in a concentration effective to cause said aqueous dispersion to remove soil from the carpet without substantially reducing the dry soil resistance provided by said vinyl polymer and perfluoroalkyl ester, an additional ingredient consisting of hydrogen peroxide;

and (2) mechanically buffing the carpet to cause foaming of said aqueous dispersion thereon.

* * * * *